United States Patent [19]

Wilson

[11] 4,285,083

[45] Aug. 25, 1981

[54] LEG ROPE

[75] Inventor: Jonathan H. Wilson, Flinders, Australia

[73] Assignee: Flinders Surfing Co. Pty. Ltd., Flinders, Australia

[21] Appl. No.: 105,616

[22] Filed: Dec. 20, 1979

[30] Foreign Application Priority Data

Jan. 3, 1979 [AU] Australia ..... PD7264

[51] Int. Cl.[3] ..... A63C 15/05

[52] U.S. Cl. ..... 9/310 E

[58] Field of Search ..... 280/637; 9/310 E, 311; 403/270, 271, 268, 379, 287, 165; 114/235, 267; 24/115 A, 241 PL; 272/75

[56] References Cited

U.S. PATENT DOCUMENTS

| | | | |
|---|---|---|---|
| 258,241 | 5/1882 | Merrill | 430/379 |
| 321,753 | 7/1885 | Phillips | 403/379 |
| 361,683 | 4/1887 | Eckhart | 403/165 |
| 2,083,402 | 6/1937 | Rowe | 403/268 |
| 3,437,549 | 4/1969 | Winer | 114/267 |
| 3,602,257 | 8/1971 | Berleyoung | 403/270 |
| 4,044,415 | 10/1977 | Wood | 9/310 E |

*Primary Examiner*—Trygve M. Blix
*Assistant Examiner*—Stephen P. Avila

[57] ABSTRACT

A leg rope for connecting a surfboard to a surfer's ankle band comprising a flexible cord provided with a moulded end piece at each end, one of the end pieces housing a swivel whereby the flexible cord can be connected to an ankle band and the other end piece carrying a braided cord or the like whereby the flexible cord can be adjustably connected to a surfboard.

9 Claims, 5 Drawing Figures

LEG ROPE

Figure 1:
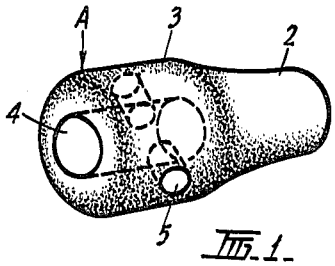

This invention relates to an improved cord or the like for connecting a surfboard to a surfer's ankle band, thereby providing a means for rapid recovery of a surfboard should a surfboard rider fall therefrom during a ride or otherwise. Such cords are commonly known as "leg ropes" and for convenience of description will be referred to hereinafter as such.

Previously known leg ropes have suffered a number of disadvantages from the point of view of cost and simplicity of construction and a number of operational disadvantages when in use. One of the simplest forms of leg rope currently available is a length of braided or woven nylon cord provided at each end with a loop, one loop being for connection to a surfboard, the other for connection to a surfer's ankle band. The loops in such a leg rope may be formed by whipping a free end of the cord back on itself in known manner, or by splicing. Such techniques, being very time consuming, are expensive to perform. In addition, woven or braided ropes have the disadvantage that they are effectively in-elastic and thus afford no shock absorbing effect should a rider become separated from his surfboard. Further, such ropes, being of a particularly flexible nature, easily form kinks or knots which reduce the effectiveness of such a leg rope.

Improved forms of leg ropes have been provided with swivel means to reduce the tendency to kink, and also shock absorbing means have been provided by firmly attaching a rubber sleeve over a portion of the rope which is slightly greater in length than the sleeve itself.

Another type of leg rope presently available which provides distinct operational advantages over the abovementioned leg rope, comprises a length of solid polyurethane extruded cord which is formed into a loop at each end by bending the cord back on itself and firmly tying the loop with a length of braided nylon cord. The tied loop portion is then inserted into a tightly fitting resilient rubber sleeve or is provided with a heat shrinkable plastic sleeve which is then shrunk to firmly locate the knotted nylon cord around the looped portion. The free ends of the nylon cords are then tied into a further loop for attachment to a surfboard at one end and an ankle band at the other end, either directly or through an intervening swivel. Such leg ropes, although offering improved operational advantages over the afore-mentioned braided or woven nylon leg ropes, nevertheless still suffer the cost disadvantage of an extensive labour component in their construction. In addition, such leg ropes have shown a tendency to fracture at the loop in the polyurethane cord after a short period of use. This fracturing is believed to occur either as a result of stress cracking in the polyurethane cord at the loop, or as a result of the polyurethane cord being cut by the relatively thin nylon cord.

It is therefore an object of the present invention to overcome the afore-mentioned disadvantages, and to provide a leg rope which is simple and inexpensive to construct and at the same time to provide a durable means of connecting a leg rope to a surfboard or a surfer's ankle band.

According to the present invention there is provided a leg rope for connecting a surfboard to a surfer's ankle band comprising a flexible cord provided at each end with an end piece, each said end piece comprising a body, one end portion of which is connected to said cord and the other end portion of which is provided with an axial inwardly extending opening and a transverse opening passing through said body substantially at right angles to the axial opening and connecting with the axial opening.

Preferably, a swivel is accommodated in the axial inwardly extending opening in one of the end pieces whereby the leg rope can be connected to an ankle band by means of a swivel connection. Preferably, one of the end pieces is provided with a braided cord or the like which extends through the transverse opening whereby the leg rope can be adjustably connected to a surfboard.

In use, the braided cord or the like projects from the axial opening in the end piece in the form of an adjustable loop.

The end pieces provided at the ends of the said flexible cord according to the present invention are preferably identical.

The flexible cord and the end pieces may be moulded from suitable synthetic plastics mateial, such as polyurethane.

Figure 2:
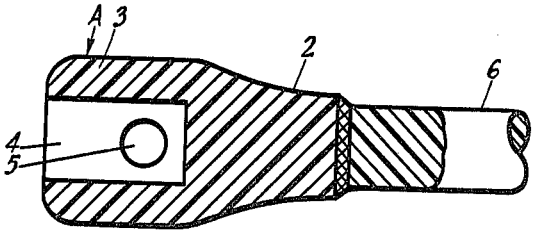
Figure 3:
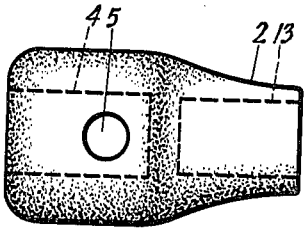
Figure 4:
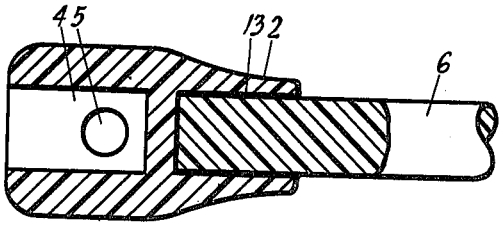
Figure 5:
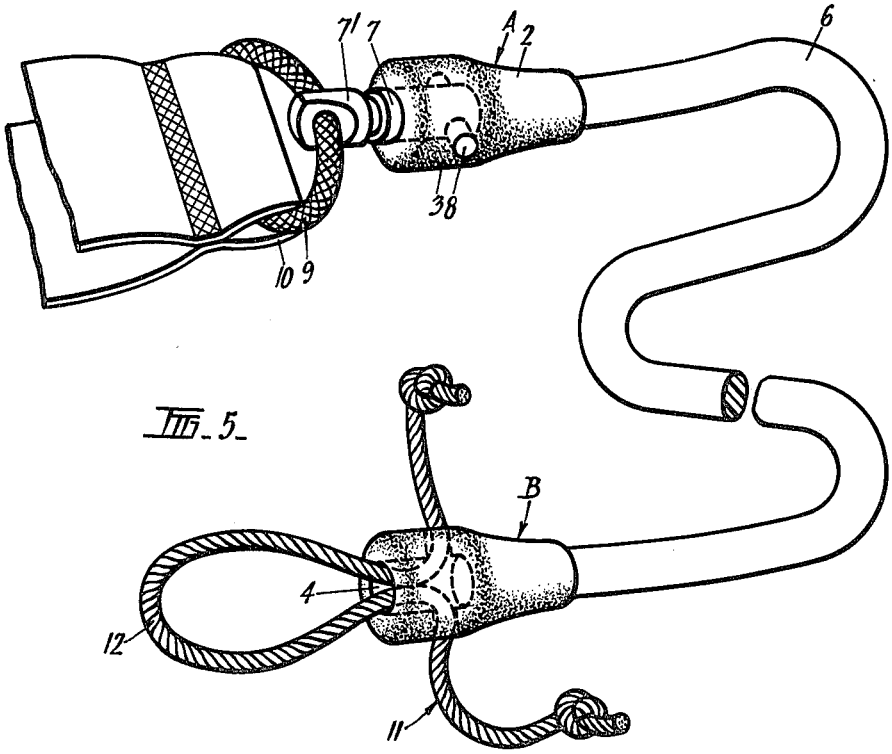

Preferred embodiments of the present invention will now be described with reference to the accompanying drawings in which:

FIG. 1 is a perspective view of one form of end piece according to the invention, FIG. 2 is a slightly enlarged view in sectional side elevation of the end piece shown in FIG. 1, connected to one end of a flexible cord, FIG. 3 is a view in side elevation of a modified form of end piece according to the invention, FIG. 4 is a view in sectional side elevation of the end piece shown in FIG. 3, connected to one end of a flexible cord, and FIG. 5 is a perspective view of a leg rope according to the present invention.

As shown in FIGS. 1 and 2, end piece A comprises a body, one end portion 2 of which is of generally frustoconical shape, while the other end portion 3 of which is of generally cylindrical shape. The cylindrical end portion 3 is provided with an axial inwardly extending opening 4, the dimensions of which are chosen to accommodate one end of a swivel. The cylindrical portion of the body is also provided with a transverse opening 5 which passes through the centre of the body at right angles to the opening 4 and opens into the opening 4 for a purpose hereinafter referred to. The end piece is formed from injection moulded polyurethane and is heat welded or sonically welded to one end of an extruded solid polyurethane cord 6 to obtain a homogenous joint with a tensile strength approximately identical to that of the cord itself.

Referring now to FIG. 5, one end 7 of a brass, bronze, stainless steel or other corrosion resistant swivel of diameter substantially the same as the axial opening 4 is inserted into that opening in end piece A and a brass, bronze, stainless steel or other corrosion resistant retaining pin 8 is then inserted into the transverse opening 5 and a hole in the end 7 of the swivel in order to retain the swivel firmly in position in the end piece. The other or free end 7' of the swivel, which extends axially outwards from the end piece A, is also provided with a hole through which passes a loop 9 formed from braided nylon cord, the loop 9 also passing through a loop of material 10 forming part of an ankle band whereby the band is connected to the cord 6 by means of a swivel connection.

At the opposite end of the cord 6, there is provided an end piece B which is identical to end piece A, and similarly to end piece A, is attached to the cord 6 by means of heat welding or sonic welding. A braided nylon cord 11 is passes through the transverse opening in the end piece B and knotted at each end to retain the cord in the end piece, the looped portion 12 then being withdrawn from the interior of axial opening 4. The cord 11 thus provides an adjustable means for connection of the cord 6 to a surfboard, said adjustment being effected by withdrawing one or both knotted portions from the end piece and tying a fresh knot or knots to shorten the length of the looped portion 12 as desired.

In the modification illustrated in FIGS 3 and 4, the end piece is provided with axial and transverse openings 4, 5 respectively as in the previously described embodiment, but in addition, has an axial opening 113 in its frusto-conical portion 2 into which an end of the flexible cord 6 is inserted and retained therein by means of a suitable solvent-type glue.

The leg rope according to the present invention is simple and relatively inexpensive in its construction and provides a means for providing a durable and adjustable connection between a surfer's ankle band and a surfboard. Moreover, the leg rope thus provided is considered to have an improved appearance compared with leg ropes of the prior art.

It is to be understood that the invention is in no way limited to the particular embodiments described and exemplified herein and that many variations can be made within the spirit and scope of the invention, which includes every novel feature and combination of features herein disclosed.

I claim:

1. A leg rope for connecting a surfboard to a surfer comprising: a flexible cord provided at each end with an end piece, each one said end pieces having a body connected to said cord and provided with an axial inwardly extending opening and a transverse opening passing through said body substantially at right angles to the axial opening and connecting with the axial opening, a swivel having an inner portion accommodated in the axial opening in one of the end pieces and an outer portion projecting beyond the said one of the end pieces whereby the leg rope can be connected to a surfer's ankle band by means of a swivel connection, a pin inserted through the transverse opening in the said one of the end pieces and through a transverse opening in the said inner portion of the swivel in alignment with the said trasverse opening in the said one of the end pieces the thereby retain the swivel in position in the end piece, and connecting means associated with the other end piece to adjustably connect the leg rope to the surfboard, the transverse openings in the end pieces being located beyond the respective ends of the cord, said one of the end pieces being connected to the cord otherwise than by means of the said pin and the said other end piece being connected to the cord otherwise than by means of the said connecting means.

2. A leg rope as claimed in claim 1, wherein the swivel is connected to an ankle band by a nylon cord or the like passing through a hole in the said outer portion of the swivel.

3. A leg rope as claimed in claim 1, wherein the connecting means associated with the said other end piece comprises a braided cord or the like extending through the transverse opening in the said other end piece.

4. A leg rope as claimed in claim 3, wherein the said braided cord or the like projects from the axial opening in the said other end piece in the form of an adjustable loop.

5. A leg rope as claimed in claim 1, wherein each end piece comprises one portion of generally frustoconical shape and another portion of generally cylindrical shape, the said axial and transverse openings being located in the portion of generally cylindrical shape.

6. A leg rope as claimed in claim 5, wherein said one portion of each end piece is connected to the flexible cord by welding.

7. A leg rope as claimed in claim 5, wherein said one portion of each end piece is provided with an opening into which an end of the flexible cord is inserted and adhesively retained therein.

8. A leg rope as claimed in claim 1, wherein the end pieces provided at the ends of the said flexible cord are identical.

9. A leg rope as claimed in claim 1, wherein the flexible cord and the end pieces are moulded from synthetic plastics material.

* * * * *